US010366681B2

(12) United States Patent
Allen

(10) Patent No.: US 10,366,681 B2
(45) **Date of Patent: *Jul. 30, 2019**

(54) INTEGRATED LUG AND DRUM MOUNT

(71) Applicant: Joshua Allen, Ann Arbor, MI (US)

(72) Inventor: Joshua Allen, Ann Arbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/978,010

(22) Filed: May 11, 2018

(65) Prior Publication Data

US 2018/0261195 A1 Sep. 13, 2018

Related U.S. Application Data

(63) Continuation of application No. 15/159,857, filed on May 20, 2016, now Pat. No. 9,792,888.

(51) Int. Cl.
*G10D 13/02* (2006.01)

(52) U.S. Cl.
CPC ..... *G10D 13/026* (2013.01)

(58) Field of Classification Search
CPC ..... G10D 13/026
See application file for complete search history.

(56) References Cited

U.S. PATENT DOCUMENTS 9,792,888 B1 * 10/2017 Allen ..... G10D 13/026

* cited by examiner

*Primary Examiner* — Kimberly R Lockett
(74) *Attorney, Agent, or Firm* — Heed Law Group PLLC; Thomas P. Heed

(57) ABSTRACT

An adjustable integrated lug and drum mount composed of an integrated lug, a U-bracket and at least one mounting component, wherein the relative position of the mounting component with respect to the U-bracket is adjustable. The integrated lug and U-bracket are durably attached to the drum shell and one another with two fasteners. The U-bracket has a planar, free member, which connects with the mounting component(s). The planar, free member has one end, attached continuously to the bulk of the U-bracket, called the joined end. The planar, free member has another end, disposed distal to the joined end, called the free end, which can vibrate. The mounting components can be mounted substantially anywhere between the joined end and the free end. The adjustment changes the stiffness with which the integrated lug and drum mount connects the drum leg or support to the drum. The integrated lug has a threaded receiver that can accept a threaded shaft from a tuning screw.

16 Claims, 7 Drawing Sheets

INTEGRATED LUG AND DRUM MOUNT

FIELD OF INVENTION

This invention relates to the class of music. Specifically, this invention relates to the sub-classes of instruments, drums, and supports.

BACKGROUND OF INVENTION

Drums are the simplest, and most primitive, musical instruments. The drum is a percussive instrument, which produces sound by striking a membrane. The sound is propagated through a membrane, or drumhead, to the drum shell, which is designed to resonate when the membrane is struck. The drumhead is coupled to the drum shell through drum hoops, lugs, and lug or hoop holders. The energy created by striking the drum head is transferred into a wave in the drum shell, producing the distinctive drum sound, a tuned impulse.

While drums usually cannot play different pitches, they are usually tuned. The drum is tuned by tightening or loosening the drumhead by adjusting the lugs and drum hoops. The tighter the drumhead, the higher the pitch propagated by the drumhead.

Many drummers use a drum kit. Drum kits have several different drums, which can be individually tuned. A drum kit is often composed of various drums, such as a bass or kick drum, snare drums, and tom drums, as well as assorted cymbals and high-hats. When a drummer is drumming, there is substantial vibration throughout the drum kit. Additionally, the various drums can move or flex as they are struck, meaning that the drums, themselves, are vibrating and, therefore, moving. This is especially true of the tom and snare drums.

A drum mount or support is a sub-classification that includes many different methods of mounting the drum to legs or to other structural elements. The mounts used for drums often degrade the sound, because the drum is held too tightly, damping or attenuating the tuned impulse. Depending on how the drum mount is attached, and how it supports the drum, it can hinder the drum shell resonance, the drumhead, or both. Any drum mount or support that rigidly fixes itself to the drum, whether to the drum shell or the drum hoops, risks damping the sound. A very small number of mounts attach to lugs or lug holders. As currently implemented, these integrated mounting brackets and lugs are a bad idea, because they fail to properly isolate the tuning of the lug from the tuning of the drum mount. The lugs are supposed to be tuning the drum. By adding additional stiffness (force) to the lugs, a fixed drum will change the tuning of the drum. An integrated lug and drum mount is conceptually attractive, because such a device, if it did not adversely affect the tuning of the drum head, would be easier to install on the drum.

Other mounts attach to the top and/or bottom hoops of the drum shell. Still other supports attach to the drum shell. Rigidly attached supports, whether mounted to the shell or hoops, will damp the vibration of the drum, and may, ultimately, distort the sound through buzzing or rattling, if the support mount is not properly engineered and attached.

As a result, a new device is needed, integrating the lug and drum mount, without unduly affecting the tuning of the drum. The new integrated lug and mount should allow the drum shell to resonate freely. Such an integrated lug and mount needs to maintain the drum, in position, without, itself, generating objectionable sounds. The integrated lug and drum mount should be quickly and easily adjustable. It should also allow for quick set-up and break-down of a drum kit. An integrated lug and drum mount that has variable stiffness, and isolates the drum shell from the structural members supporting the drum would be ideal.

SUMMARY OF THE INVENTION

This summary is intended to disclose the present invention, an integrated lug and drum mount that does not unduly affect the tuning of the drumhead. The embodiments and descriptions are used to illustrate the invention and its utility, and are not intended to limit the invention or its use. The present invention, an integrated lug and drum mount, has three essential pieces: a lug, a fixed component, and a mounting component. Both the fixed component and the mounting component can, themselves, be composed of multiple individual pieces or sub-components. In the embodiment used to illustrate the invention, herein, the fixed component is a U-bracket and the mounting component is comprised of the following sub-components: a screw plate, a receiver hub, and a connecting member.

The U-bracket is a planar member bent into a "U," creating three distinct regions: a fixed member, a curved portion, and a free member. The U-bracket has an inner surface and an outer surface. The U-bracket has two edges. The U-bracket has a planar member that connects to the drum shell, called a fixed member. The U-bracket has a planar member, called the free member, which connects with the mounting component(s). The fixed member, curved portion, and free member are continuous, molded from a single piece of plastic or stamped from a single piece of metal. The fixed member has an end, called the lug end, distal to the curved portion. The free member has an end, called the free end, distal to the curved portion. The curved portion connecting the free member to the fixed member allows the free member to move relative with the fixed member. The mounting components can be mounted substantially anywhere along the free member between the free end and the curved portion. The closer the mounting component(s) are mounted to the curved portion, the relatively stiffer the mounting system. The closer the mounting component(s) are mounted to the free end, the relatively less stiff the mounting system.

In the illustrated embodiment, the mounting component has a screw plate, a receiver hub, and a connecting member. The screw plate is a flat, planar member with two holes in it. The receiver hub has a front surface and a rear surface. The rear surface of the receiver hub is flat, and mates with the free member of the U-bracket. Running longitudinally down the front surface of the receiver hub is a channel. On each side of the channel is a raised plateau, centered on the long-axis of the front surface of the receiver hub. On each side of the channel are two holes. One hole on each side is centered on the raised plateau. On the left side of the receiver hub, the second hole is below the raised plateau. On the right side of the receiver hub, the second hole is above the raised plateau. The receiver hub is made from homogeneous material. The centroid of the receiver hub is roughly the geometric center of the receiver hub.

The connecting member has a substantially rectangular base, with a front surface and a rear surface. On the rear surface of the connecting member rectangular base, there is a channel parallel to the short sides of the rectangular surface that is centered on the rear surface. There are two holes through the connecting member, positioned on either side of the channel.

The receiver hub is connected to the U-bracket with two threaded fasteners. The threaded fasteners from the receiver hub pass through elongated slots in the U-bracket, fastening to the screw plate. The connecting member fastens to the receiver hub with two additional threaded fasteners. In one embodiment, the connecting member has a bolt fastener that mates with a threaded screw post through the receiver hub, and a wing nut that mates with a second threaded screw post through the receiver hub. In another embodiment, the connecting member has two bolt fasteners. A drum leg or support can be securely captured and retained between the connecting member and receiver hub. In one embodiment, the free member of the U-bracket has a hole and slot configuration comprised of just holes and the receiver hub is fixed to one of a plurality of positions. In another embodiment, the free member of the U-bracket has hole and slots configuration of just slots, and the receiver hub can be located anywhere along the length the free member. The relative position of the support, such as a drum leg, can be adjusted by moving the receiver hub along the length of the free member of the U-bracket. With the support relatively closer to the curved portion, the mounting will be relatively stiffer. With the support relatively closer to the free end of the free member, the mounting will relatively less stiff. In this way, the stiffness of the support mounting system can be easily adjusted. Additionally, the user can select the appropriate position for their particular style, adjusting the integrated lug and drum mount to get the preferred amount of stiffness.

The tension of the drumhead is controlled by a drum hoop and a plurality of threaded fasteners called tuning screws. The tuning screws extend through the drum hoop towards the center of the cylindrical drum shell. The tuning screws terminate in lugs that are connected to the drum shell. By tightening the tuning screws, the drumhead is made stiffer. By loosening the tuning screws, the drumhead is made less stiff. Traditionally, lugs are held onto the shell with threaded fasteners.

The integrated lug is composed of a retaining portion and a rectangular portion. The rectangular portion of the lug and the fixed member of the U-bracket are connected to the drum shell with threaded fasteners. The retaining portion of the integrated lug has a threaded hole to receive a tuning screw. As with all the other lugs, the tuning screw that inserts into the retaining portion of the integrated lug can be adjusted by tightening or loosening it, thereby adding or subtracting stiffness from the drum hoop and drumhead.

The integrated lug and drum mount components can be fabricated from stiff, environmentally durable materials such as poly(methyl-methacrylate) ("PMMA" or tradenames Plexiglass or Lucite®), polycarbonate ("PC" or tradename Lexan®), acrylonitrile butadiene styrene ("ABS"), polypropylene ("PP"), high-density polyethylene ("HDPE"), low-density polyethylene ("LDPE"), wood, zinc, steel, or aluminum. The integrated lug and drum mount components can be fabricated from steel, which can be punched or forged. The integrated lug and drum mount components can also be fabricated from appropriate polymers, using standard manufacturing processes, such as injection molding. In the first embodiment, the U-bracket is fabricated from spring steel, while the connecting member and receiver hub are cast from zinc.

BRIEF DESCRIPTION OF THE DRAWINGS

The present invention is illustrated with 7 drawings on 7 sheets.

DETAILED DESCRIPTION OF THE DRAWINGS

The following descriptions are not meant to limit the invention, but rather to add to the summary of invention, and illustrate the present invention, an integrated lug and drum mount. The present invention is illustrated with a variety of drawings showing various possible embodiments.

Figure 1:
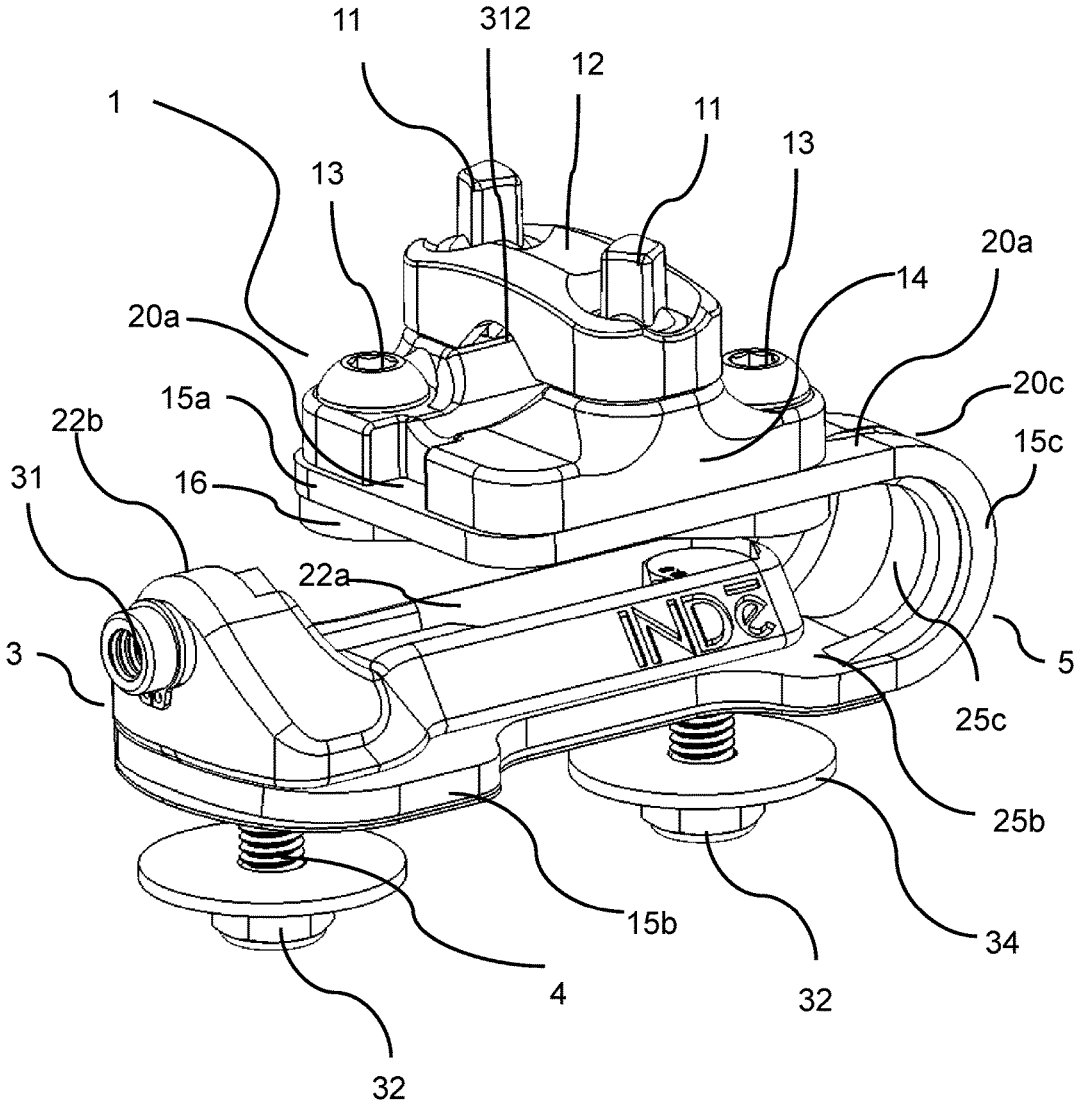
FIG. 1 is an isolated perspective drawing of the present.

In FIG. 1, the present invention 1, an integrated lug and drum mount 1, has three essential pieces: a U-bracket 5, a mounting component 12, 14, 16, and an integrated lug 3. The U-bracket 5 is a planar member bent into a "U." The U-bracket 5 has an interior surface 25*b*, 25*c*, an edge 15*a*, 15*b*, 15*c* and an exterior surface 20*a*, 20*b*. The U-bracket has a fixed member 15*b*, 25*b*, and a free member 20*a*, 15*a*, connected, continuously, by a curved portion 15*c*, 20*c*, 25*c*.

The receiver hub 14 is attached to the exterior surface of the free member 20*a* with two threaded fasteners 13. The threaded fasteners 13 pass through the free member 20*a*, connecting with a screw plate 16. The connecting member 12 is held to the receiver hub 14 with a pair of threaded fasteners 11. The connecting member 12 has a channel 312.

The integrated lug 3 is mated to the interior surface of the fixed member 25*b* of the U-bracket 5. The integrated lug 3 has a rectangular portion 22*a* and a retaining portion 22*b*. The retaining portion 22*b* of the integrated lug 3 has a threaded receiver 31. A pair of threaded fasteners 4 pass through the rectangular portion 22*a* of the integrated lug 3 and the fixed member 25*b* of the U-bracket 5. The threaded fasteners 4 are captured by bolts 32 and washers 34. In use, the fixed member 25*b* of the U-bracket 5 would be connected to a drum shell (not shown in FIG. 1) by the threaded fasteners 4 with the bolts 32 and washers 34 on the inside of the drum shell.

Figure 2A:
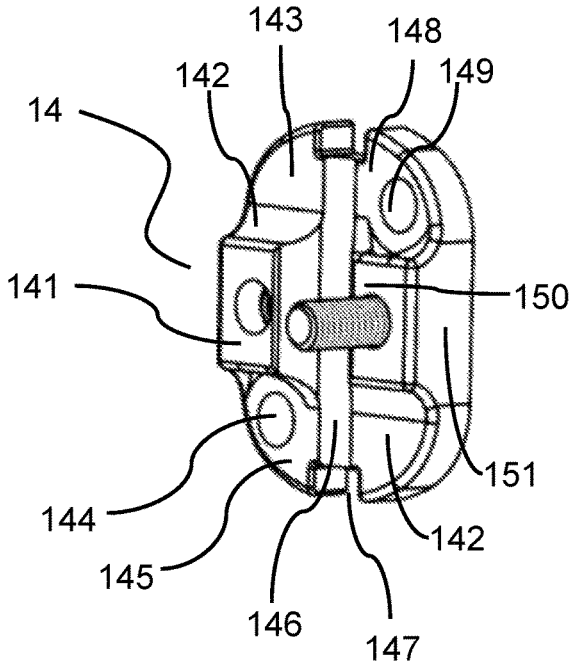
FIG. 2A is an isolated perspective of the receiver hub.
Figure 2B:
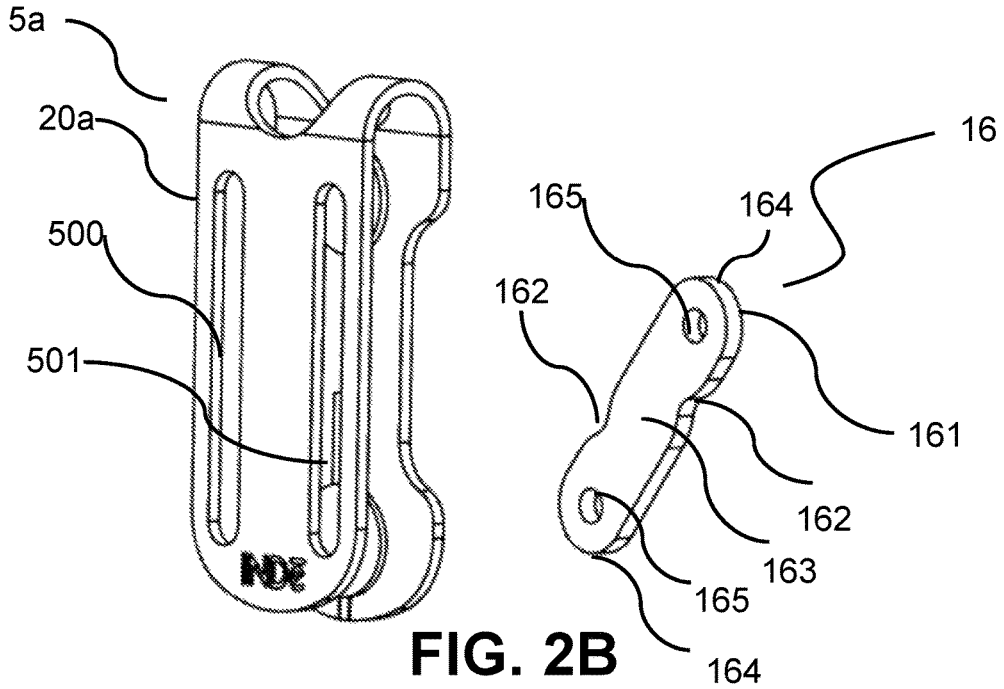
FIG. 2B is an isolated perspective of the screw plate and an embodiment of the U-bracket.

FIG. 2A and 2B show the receiver hub 14, an embodiment of the U-bracket with slots, and the screw plate 16. The receiver hub 14 has two threaded fastener holes 144, 149 which mate with two threaded fastener holes 165 in the screw plate 16. The receiver hub 14 has a center channel 146 with a notch at either end 147. The top surface of the receiver hub 14 is bifurcated by the center channel 146. The connecting member 12 channel 312 and receiver hub 14 center channel 146 create an opening capable of retaining a drum support member for mounting a drum. The top surface of the receiver hub 14 has four lower surfaces 143, 148, 142, 145 and two upper surfaces 141, 150. The receiver hub 14 has transition surfaces 142 between the lower surfaces 143, 148, 142, 145 and the upper surfaces 141, 150. The receiver hub 14 has a side surface 151.

The screw plate 16 has a planar surface 163 with two rounded ends 164. The planar surface 163 has two notches 162. The screw plate 16 has an edge 161. The U-bracket 5*b* has two slots 500, 501 as its hole and slot configuration on the free member 20*a*.

Figure 3:
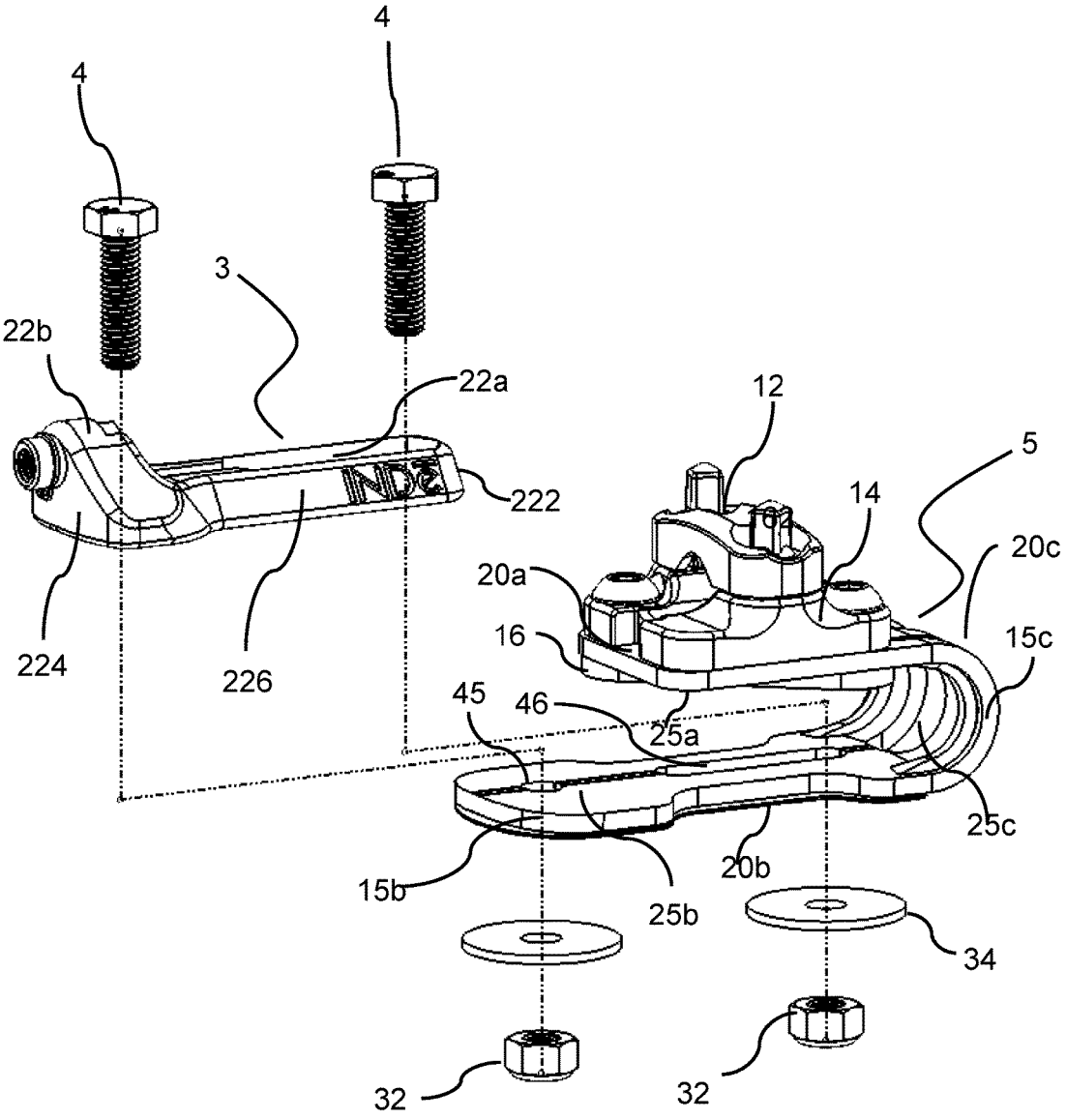
FIG. 3 is an exploded perspective view of the present invention. side view of the present invention installed on a snare drum.

FIG. 3 is an exploded view of the present invention 1. The U-bracket 5, mounting component 12, 14, 16, and an integrated lug 3 are all visible in the exploded view. The U-bracket 5 is a planar member bent into a "U." The U-bracket 5 has an interior surface 25*a*, 25*b*, 25*c*, an edge 15*a*, 15*b*, 15*c* and an exterior surface 20*a*, 20*b*, 20*c*. The U-bracket 5 has a fixed member 15*b*, 20*b*, 25*b*, and a free member 25*a*, 20*a*, 15*a*, connected, continuously, by a curved portion 15*c*, 20*c*, 25*c*. There is a hole 45 and slot 46 in the fixed member 15*b*, 20*b*, 25*b* to receive the threaded fastener 4. The threaded fasteners 4 fit through the hole 45 and slot 46 and attach the integrated lug 3 and U-bracket 5 to the drum shell (See FIG. 5 200) with bolts 32 and washers 34.

The receiver hub 14 is attached to the exterior surface of the free member 20*a* with a screw plate 16. The connecting member 12 is connected to the receiver hub 14.

The integrated lug 3 is mated to the interior surface of the fixed member 25*b* of the U-bracket 5. The integrated lug 3 has a rectangular portion 22*a* and a retaining portion 22*b*. The integrated lug 3 has a lateral surface 224 on the retaining portion 22*b* and lateral surfaces 226, 222 on the rectangular portion.

Figure 4:
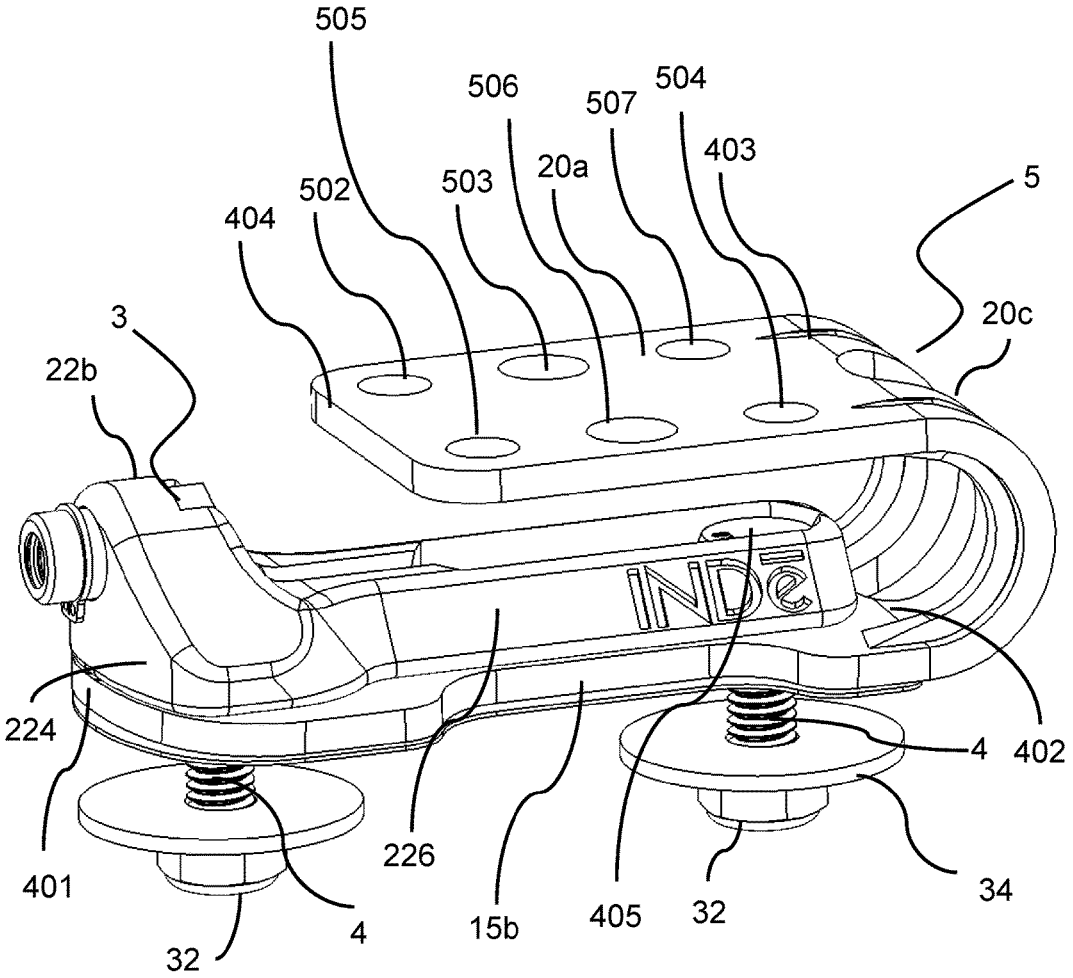
FIG. 4 is an isolated perspective view of the U-bracket and integrated lug.

FIG. 4 is an isolation of the U-bracket 5 and integrated lug 3. The exterior surface of the free member 20*a* is easily seen in this view. The retaining portion 22*b* and its lateral surface 224 are emphasized in this view, as is the lateral surface 226 of the rectangular portion 22*a*. The threaded fastener 4 has a cap 405 and a shaft 4. The positioning of the threaded fasteners 4, bolts 32 and washers 34 are readily apparent in this view. The rectangular portion 22*a* has a slot and hole configuration allowing at least two threaded fasteners to pass through and be captured. The rectangular portion 22*a* is capable of retaining the cap 405 of the threaded fastener 4. The free member 20*a* has two ends 404, 403. One end 404 is a free end 404; the other end 403 is a joined end, being joined to the curved portion 20*c*. The fixed member 15*b* has two ends 401, 402. One end 401 is the lug end; the other end 402 is a joined end 402, being joined to the curved portion 20*c*. The U-bracket 5 has a plurality of holes 502, 503, 504, 505, 506, 507 as its hole and slot configuration. A U-bracket 5, 5*a* can have a plurality of holes 502, 503, 504, 505, 506, 507 and slots 500, 501 as its hole and slot configuration.

Figure 5:
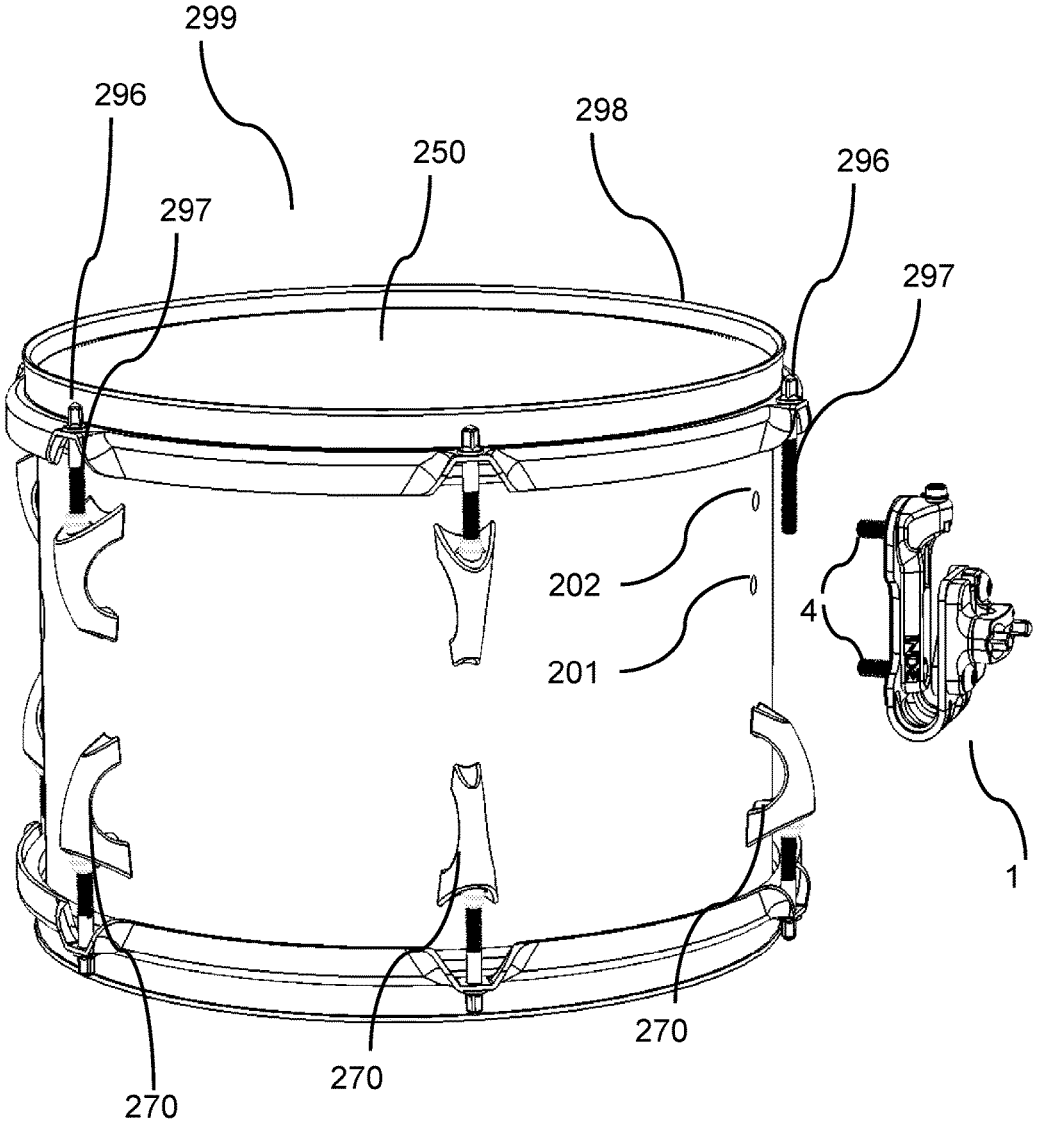
FIG. 5 is a side view of the present invention relative to a drum prior to fastening.

FIG. 5 shows the present invention 1, an integrated lug and drum mount 1 in relationship to a drum 299. The drum 266 is comprised of a drumhead 250, two drum hoops 298, a drum shell 200, a plurality of lugs 270, and a plurality of tuning screws 296, 297. The tuning screws have a head 296 and a threaded shaft 297. The threaded shaft 297 is received by the lugs 270. This view shows two holes 201, 202 in the drum shell 200 into which the threaded fasteners 4 of the present invention 1 fit.

Figure 6:
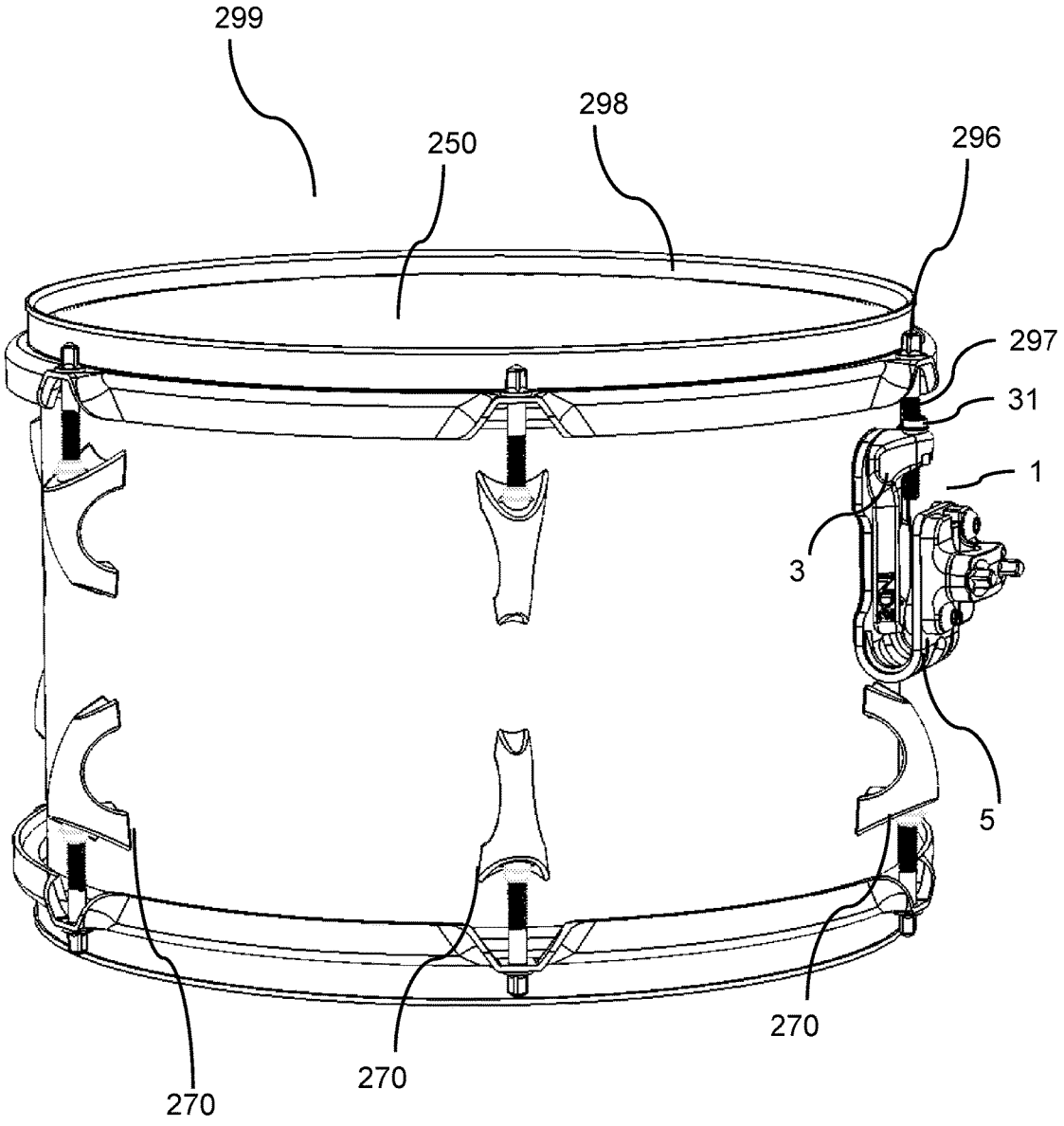
FIG. 6 is the present invention fastened to a drum. isometric view of the present invention.

FIG. 6 shows the present invention 1 attached to the drum shell 200 of the drum 299. A tuning screw 296, 297, fits through the drum hoop 298. The threaded shaft 297 of the tuning screw is received by the integrated lug 3 threaded receiver 31. The fixed member 15*b* of the U-bracket 5 is attached to the drum shell 200.

Figure 7:
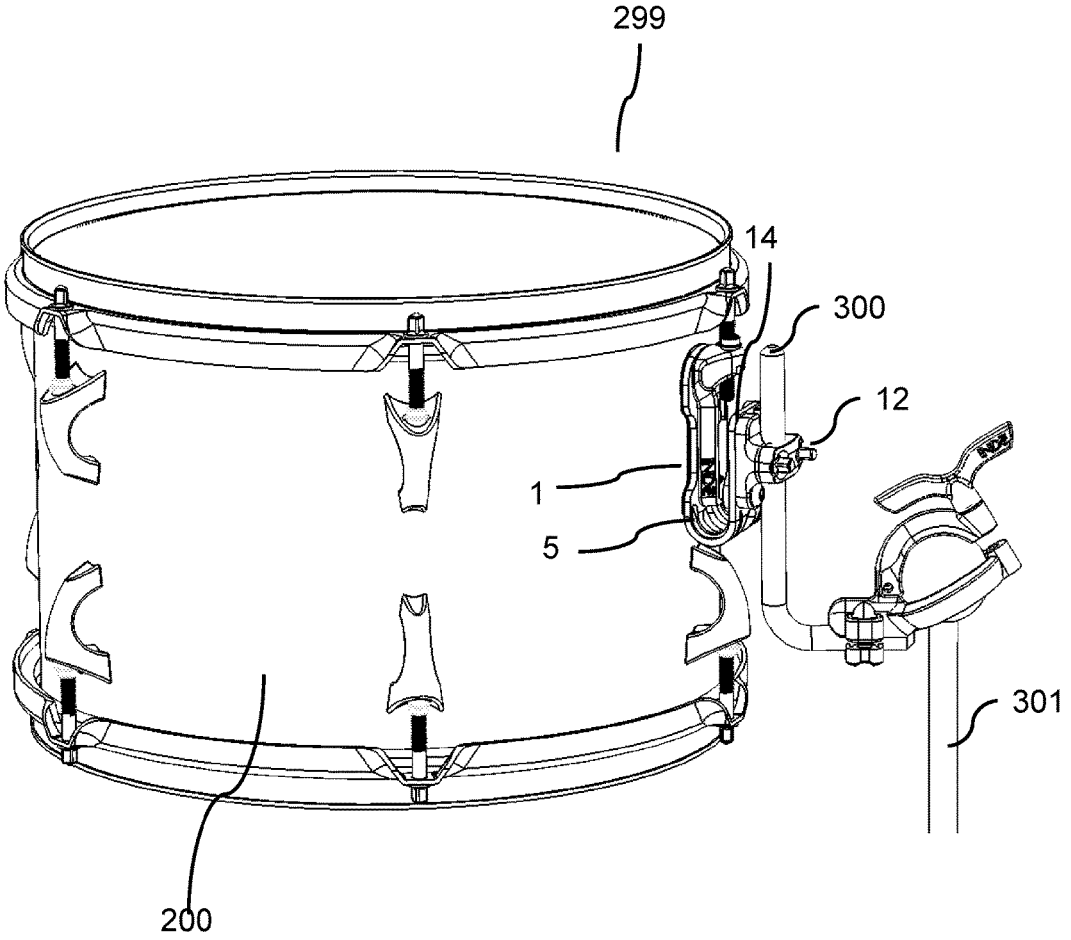
FIG. 7 is the present invention fastened to a drum with a drum mount attached to the present invention.

FIG. 7 shows the present invention 1 mounted to a drum shell 200. The drum 299 is attached to a drum stand 301 through the cylindrical mounting member 300 of the drum stand 301. The receiver hub 14 and connecting member 12 capture the mounting member 300 of the drum stand 301.

The integrated lug and drum mount 1 components 3, 5, 12, 14, 16, can be fabricated from stiff, environmentally durable materials such as poly(methyl-methacrylate) ("PMMA" or tradenames Plexiglass or Lucite®), polycarbonate ("PC" or tradename Lexan®), acrylonitrile butadiene styrene ("ABS"), polypropylene ("PP"), high-density polyethylene ("HDPE"), low-density polyethylene ("LDPE"), wood, zinc, steel, or aluminum. The integrated lug and drum mount 1 components 3, 5, 12, 14, 16 can be fabricated from steel, which can be punched (stamped) and/or forged (hot or cold). The integrated lug and drum mount 1 components 3, 5, 12, 14, 16 can also be fabricated from appropriate polymers, using standard manufacturing processes, such as injection molding. In the illustrated embodiment, the U-bracket 5 is fabricated from spring steel, while the integrated lug 3, the connecting member 12, the screw plate 16, and receiver hub 14 are cast from zinc.

I claim:

1. An integrated lug and drum mount comprising
an integrated lug,
a U-bracket, and
a mounting component, wherein
the U-bracket has a two planar members with opposing surface, and a curved portion, continuously connected to the two planar members with opposing surfaces, wherein one planar member is the fixed member and one planar member is the free member;
the fixed member has two ends, one end connected continuously to the curved portion called the joined end and one end, distal to the curved portion, called the lug end;
the free member has two ends, one end connected continuously to the curved portion called the joined end and one end, distal to the curved portion, called the free end; and
the fixed member is fixed relative to the drum shell; and the free member is free relative to the drum shell, meaning that the free member can move relative to the drum shell.

2. The integrated lug and drum mount of claim 1, wherein the mounting component is comprised of four threaded fasteners, a substantially planar screw plate having two holes; a receiver hub; and a connecting member,
wherein the mounting component is fastened to the free member by having two threaded fasteners connect the screw plate, on one side of the free member, to the receiver hub on the other side of the free member.

3. The integrated lug and drum mount of claim 2, wherein the free member of the U-bracket has two parallel slots;
wherein the mounting component can be re-positioned on the free member by loosening, but not removing, the threaded fasteners connecting the receiver hub to the screw plate; and
wherein the mounting component can be fastened to the free member substantially anywhere along the length of the free member from the joined end to the free end.

4. The integrated lug and drum mount of claim 2, wherein the free member of the U-bracket has a plurality of mounting holes; and
wherein the mounting component can be fastened to the U-bracket using the mounting holes.

5. The integrated lug and drum mount of claim 2, wherein the receiver hub has a center channel.

6. The integrated lug and drum mount of claim 5, wherein the connecting member has a channel.

7. The integrated lug and drum mount of claim 6, wherein the connecting member channel and the receiver hub center channel are capable of capturing and retaining a cylindrical mounting member of a drum stand.

8. The integrated lug and drum mount of claim 7, wherein the integrated lug has retaining portion containing a receiver for a threaded fastener.

9. The integrated lug and drum mount of claim 8, further comprising at least two threaded fasteners, each threaded fastener having a shaft and a cap, wherein the fixed member of the U-bracket has one hole and one slot, the integrated lug has a rectangular portion with a slot and hole configuration allowing the caps of the at least two threaded fasteners to be captured; and wherein the threaded shaft of the at least two threaded fasteners can pass through the integrated lug, the fixed member of the U-bracket, and a shell of a drum.

10. The integrated lug and drum mount of claim 9, further comprising at least two washers and two nuts, wherein the nuts and washers are capable of capturing and retaining the threaded shaft of each threaded fasteners, securing the U-bracket and integrated lug to the drum shell.

11. The integrated lug and drum mount of claim 10, wherein the U-bracket, receiver hub, connecting member, and screw plate are fabricated from one of wood, zinc, steel, aluminum, poly(methyl-methacrylate) ("PMMA"), polycarbonate ("PC), acrylonitrile butadiene styrene ("ABS"), polypropylene ("PP"), high-density polyethylene ("HDPE"), and low-density polyethylene ("LDPE").

12. The integrated lug and drum mount of claim 11, wherein the U-bracket is fabricated from spring steel.

13. The integrated lug and drum mount of claim 12, wherein the integrated lug, receiver hub and connecting member are fabricated from cast zinc.

14. The integrated lug and drum mount of claim 3, wherein a mounting location of the receiver hub with respect to the U-bracket can be defined as a relative position; and wherein the relative position of the receiver hub with respect to the free member of the U-bracket can be varied without disconnecting the connecting member from the receiver hub or removing the cylindrical mounting member from between the receiver hub and connecting member, by adjusting the fasteners that connect the receiver hub to the screw plate.

15. The integrated lug and drum mount of claim 2 wherein the integrated lug is further comprised of a threaded receiver in the retaining portion; and wherein the threaded receiver of the retaining portion of the integrated lug can receive a threaded shaft from a tuning screw used to hold a drum hoop to the drumhead and drum shell.

16. The integrated lug and drum mount of claim 15, wherein the tuning screw can be tightened or loosened, thereby tightening or loosening the drumhead.

* * * * *